US009401151B2

(12) United States Patent
Lang et al.

(10) Patent No.: US 9,401,151 B2
(45) Date of Patent: Jul. 26, 2016

(54) PARAMETRIC ENCODER FOR ENCODING A MULTI-CHANNEL AUDIO SIGNAL

(71) Applicant: Huawei Technologies Co., Ltd., Shenzhen, Guangdong (CN)

(72) Inventors: Yue Lang, Munich (DE); David Virette, Munich (DE); Jianfeng Xu, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 223 days.

(21) Appl. No.: 14/102,024

(22) Filed: Dec. 10, 2013

(65) Prior Publication Data

US 2014/0098963 A1 Apr. 10, 2014

Related U.S. Application Data

(63) Continuation of application No. PCT/EP2012/052734, filed on Feb. 17, 2012.

(51) Int. Cl.

| | |
|---|---|
| ***H04R 5/00*** | (2006.01) |
| ***G10L 19/008*** | (2013.01) |
| ***H04S 3/00*** | (2006.01) |

(52) U.S. Cl.

CPC ..... *G10L 19/008* (2013.01); *H04S 3/008* (2013.01); *H04S 2400/03* (2013.01); *H04S 2420/03* (2013.01)

(58) Field of Classification Search

CPC ..... G10L 19/008; G10L 19/0204
USPC ..... 381/23
See application file for complete search history.

(56) References Cited

U.S. PATENT DOCUMENTS

| | | | |
|---|---|---|---|
| 8,200,500 | B2 | 6/2012 | Baumgarte et al. |
| 2005/0180579 | A1 | 8/2005 | Baumgarte et al. |

(Continued)

FOREIGN PATENT DOCUMENTS

| | | | |
|---|---|---|---|
| CN | 101460997 | A | 6/2009 |
| CN | 101578658 | A | 11/2009 |

(Continued)

OTHER PUBLICATIONS

J. Herre, et al., "Spatial Audio Coding: Next-generation efficient and compatible coding of multi-channel audio", Audio Engineering Society, Convention Paper 6186, Presented at the 117th Convention, Oct. 28-31, 2004, 13 pages.

(Continued)

*Primary Examiner* — Alexander Jamal

(57) ABSTRACT

The invention relates to a parametric audio encoder, comprising a parameter generator, the parameter generator being configured to determine a first set of encoding parameters and reference audio signal values, wherein the reference audio signal is another audio channel signal or a downmix audio signal derived from at least two audio channel signals of the plurality of multi-channel audio signals, to determine a first encoding parameter average based on the first set of encoding parameters of the audio channel signal, to determine a second encoding parameter average based on the first encoding parameter average of the audio channel signal and at least one other first encoding parameter average of the audio channel signal, and to determine the encoding parameter based on the first encoding parameter average of the audio channel signal and the second encoding parameter average of the audio channel signal.

19 Claims, 4 Drawing Sheets

(56) References Cited

U.S. PATENT DOCUMENTS

| | | | | |
|---|---|---|---|---|
| 2007/0208565 | A1 | 9/2007 | Lakaniemi et al. | |
| 2008/0224901 | A1 | 9/2008 | Pang et al. | |
| 2010/0076774 | A1 | 3/2010 | Breebaart | |
| 2010/0235171 | A1 * | 9/2010 | Takagi | G10L 19/008 704/500 |
| 2011/0202337 | A1 * | 8/2011 | Fuchs | G10L 19/20 704/231 |
| 2012/0213377 | A1 | 8/2012 | Henn et al. | |
| 2012/0224702 | A1 * | 9/2012 | Den Brinker | G10L 19/008 381/122 |
| 2013/0262130 | A1 * | 10/2013 | Ragot | G10L 19/008 704/500 |
| 2014/0098963 | A1 * | 4/2014 | Lang | G10L 19/008 381/23 |
| 2014/0222439 | A1 | 8/2014 | Jung et al. | |
| 2014/0343954 | A1 | 11/2014 | Villemoes | |

FOREIGN PATENT DOCUMENTS

| | | | |
|---|---|---|---|
| EP | 1 565 036 | A2 | 8/2005 |
| JP | 2004535145 | A | 11/2004 |
| JP | 2005229612 | A | 8/2005 |
| JP | 2007529031 | A | 10/2007 |
| JP | 2009512271 | A | 3/2009 |
| JP | 2009526264 | A | 7/2009 |
| JP | 2013507664 | A | 3/2013 |
| KR | 10-2006-0041891 | | 5/2006 |
| WO | WO 2006/000952 | A1 | 1/2006 |
| WO | WO 2007/010785 | A1 | 1/2007 |
| WO | WO 2011/045409 | A1 | 4/2011 |
| WO | WO 2011/072729 | A1 | 6/2011 |
| WO | WO 2012/040897 | A1 | 4/2012 |

OTHER PUBLICATIONS

Christof Faller, et al., "Binaural Cue Coding—Part II: Schemes and Applications", IEEE Transactions on Speech and Audio Processing, vol. 11, No. 5, Nov. 2003, p. 520-531.

"Advances in Parametric Coding for High-Quality Audio", Audio Engineering Society Convention Paper 5852, Mar. 22-25, 2003, 11 pages.

Christof Faller, et al., "Efficient Representation of Spatial Audio Using Perceptual Parametrization", Oct. 21-24, 2001, p. 199-202.

Jeroen Breebaart, et al., "Parametric Coding of Stereo Audio", EURASIP Journal on Applied Signal Processing, 2005, p. 1305-1322.

Yue Lang, et al., "Novel Low Complexity Coherence Estimation and Synthesis Algorithms for Parametric Stereo Coding", 20th European Signal Processing Conference, Aug. 27-31, 2012, 5 pages.

* cited by examiner

PARAMETRIC ENCODER FOR ENCODING A MULTI-CHANNEL AUDIO SIGNAL

CROSS-REFERENCE TO RELATED APPLICATIONS

This application is a continuation of International Application No. PCT/EP2012/052734, filed on Feb. 17, 2012, which is hereby incorporated by reference in its entirety.

TECHNICAL FIELD

The present invention relates to audio coding.

BACKGROUND

Parametric stereo or multi-channel audio coding, as described for example in C. Faller and F. Baumgarte, "Efficient representation of spatial audio using perceptual parametrization," in Proc. IEEE Workshop on Appl. of Sig. Proc. to Audio and Acoust., October 2001, pp. 199-202, uses spatial cues to synthesize multi-channel audio signals from down-mix audio signals (usually mono or stereo), the multi-channel audio signals having more channels than the down-mix audio signals. Usually, the down-mix audio signals result from a superposition of a plurality of audio channel signals of a multi-channel audio signal, e.g., of a stereo audio signal. These less channels are waveform coded and side information, i.e., the spatial cues, related to the original signal channel relations is added as encoding parameters to the coded audio channels. The decoder uses this side information to re-generate the original number of audio channels based on the decoded waveform coded audio channels.

A basic parametric stereo coder may use inter-channel level differences (ILD) as a cue needed for generating the stereo signal from the mono down-mix audio signal. More sophisticated coders may also use the inter-channel coherence (ICC), which may represent a degree of similarity between the audio channel signals, i.e., audio channels. Furthermore, when coding binaural stereo signals e.g., for 3D audio or headphone based surround rendering, also an inter-channel phase difference (IPD) may play a role to reproduce phase/delay differences between the channels.

The synthesis of ICC cues may be relevant for most audio and music contents to re-generate ambience, stereo reverberation, source width, and other perceptions related to spatial impression as described in J. Blauert, Spatial Hearing: The Psychophysics of Human Sound Localization, The MIT Press, Cambridge, Mass., USA, 1997. Coherence synthesis may be implemented by using de-correlators in frequency domain as described in E. Schuijers, W. Oomen, B. den Brinker, and J. Breebaart, "Advances in parametric coding for high-quality audio," in Preprint 114th Cony. Aud. Eng. Soc., March 2003. However, the known synthesis approaches for estimating the spatial cues and synthesizing multi-channel audio signals may suffer from an increased complexity. Furthermore, the use of ICC parameters, in addition to other parameters, such as inter-channel level differences (ICLDs) and inter-channel phase differences (ICPDs), may increase a bitrate overhead.

SUMMARY

It is the object of the invention to provide a concept for estimating encoding parameters representing inter-channel relationships between channels of a multi-channel audio signal for an efficient audio signal encoding.

This object is achieved by the features of the independent claims. Further implementation forms are apparent from the dependent claims, the description and the figures.

In order to describe the invention in detail, the following terms, abbreviations and notations will be used:

BCC: Binaural cues coding, coding of stereo or multi-channel signals using a down-mix and binaural cues (or spatial parameters) to describe inter-channel relationships.

Binaural cues: Inter-channel cues between the left and right ear entrance signals (see also ITD, ILD, and IC).

CLD: Channel level difference, same as ICLD.

FFT: Fast implementation of the DFT, denoted Fast Fourier Transform.

STFT Short-time Fourier transform.

HRTF: Head-related transfer function, modeling transduction of sound from a source to left and right ear entrances in free-field.

IC: Inter-aural coherence, i.e. degree of similarity between left and right ear entrance signals. This is sometimes also referred to as IAC or interaural cross-correlation (IACC).

ICC: Inter-channel coherence, inter-channel correlation.

ICPD: Inter-channel phase difference. Average phase difference between a signal pair.

ICLD: Inter-channel level difference.

ICTD: Inter-channel time difference.

ILD: Interaural level difference, i.e. level difference between left and right ear entrance signals. This is sometimes also referred to as interaural intensity difference (IID).

IPD: Interaural phase difference, i.e. phase difference between the left and right ear entrance signals.

ITD: Interaural time difference, i.e. time difference between left and right ear entrance signals. This is sometimes also referred to as interaural time delay.

Mixing: Given a number of source signals (e.g. separately recorded instruments, multitrack recording), the process of generating stereo or multi-channel audio signals intended for spatial audio playback is denoted mixing.

Spatial audio: Audio signals which, when played back through an appropriate playback system, evoke an auditory spatial image.

Spatial cues: Cues relevant for spatial perception. This term is used for cues between pairs of channels of a stereo or multi-channel audio signal (see also ICTD, ICLD, and ICC), also denoted as spatial parameters or binaural cues.

According to a first aspect, the invention relates to a parametric audio encoder for generating an encoding parameter for an audio channel signal of a plurality of audio channel signals of a multi-channel audio signal, each audio channel signal having audio channel signal values, the parametric audio encoder comprising a parameter generator, the parameter generator being configured

- to determine for the audio channel signal of the plurality of audio channel signals a first set of encoding parameters from the audio channel signal values of the audio channel signal and reference audio signal values of a reference audio signal, wherein the reference audio signal is another audio channel signal of the plurality of audio channel signals,
- to determine for the audio channel signal a first encoding parameter average based on the first set of encoding parameters of the audio channel signal,
- to determine for the audio channel signal a second encoding parameter average based on the first encoding parameter average of the audio channel signal and at least one other first encoding parameter average of the audio channel signal, and to determine the encoding parameter based on the first encoding parameter average of the audio channel signal and the second encoding parameter average of the audio channel signal.

The reference audio signal can be one of the audio channel signals of the multi-channel audio signal. In particular, the reference audio signal can be either a left or a right audio channel signal of a stereo signal forming an embodiment of a two-channel multi-channel signal. However, the reference audio signal can be any signal forming a reference for determining the encoding parameters. Such reference signal may be formed by a mono downmix audio signal after downmixing the channels of the multichannel-audio signal, or one of the channel of a downmix audio signal after downmixing the channels of the multichannel-audio signal.

The parametric audio encoder can have a low complexity as it does not require a coherence or correlation computation. It even provides an accurate estimate of the relationship between the audio channels when the ICC is quantized with a rough quantizer requiring only a few steps. Especially for music signals, but also for speech signals, using the encoding parameter for the encoding of the audio signals is important because the output music sounds more natural with the correct sound scene width, and not "dry". For very low bitrate parametric stereo audio coding scheme, the bit budget is limited and only one full band ICC is transmitted, the encoding parameter is able to represent the global correlation between the channels.

In a first possible implementation form of the parametric audio encoder according to the first aspect, the first set of encoding parameters are ones of the following parameters: inter-channel level difference, inter-channel phase difference, inter-channel coherence, inter-channel intensity difference, sub-band inter-channel level difference, sub-band inter-channel phase difference, sub-band inter-channel coherence, and sub-band inter-channel intensity difference.

Such parameters represent a degree of similarity between the audio signals and can thus be used by the encoder for reducing information to be transmitted and thus reducing computational complexity.

In a second possible implementation form of the parametric audio encoder according to the first aspect or according to the first implementation form of the first aspect, the parameter generator is configured to determine phase differences of subsequent audio channel signal values to obtain the first set of encoding parameters.

Phase differences of subsequent audio channel signals are required for reproducing phase and/or delay differences between the channels. When phase differences are reproduced, speech and music sound more natural.

In a third possible implementation form of the parametric audio encoder according to the first aspect or according to any of the preceding implementation forms of the first aspect, the audio channel signal and the reference audio signal are frequency-domain signals, and the audio channel signal values and the reference audio signal values are associated with frequency bins or frequency sub-bands.

The frequency resolution used is largely motivated by the frequency resolution of the auditory system. Psychoacoustics suggests that spatial perception is most likely based on a critical band representation of the acoustic input signal. This frequency resolution is considered by using an invertible filter-bank with sub-bands with bandwidths equal or proportional to the critical bandwidth of the auditory system. Thus, the parametric audio encoder can be well adapted to human perception.

In a fourth possible implementation form of the parametric audio encoder according to the first aspect or according to any of the preceding implementation forms of the first aspect, the parametric audio encoder further comprises a transformer for transforming a plurality of time-domain audio channel signals in frequency domain to obtain the plurality of audio channel signals.

Equalization of the channel impulse response can be efficiently performed in frequency domain as the convolution in time domain is a multiplication in frequency domain. Thus, performing the computations of the parametric audio encoder in frequency domain can result in a higher efficiency with respect to computational complexity or in a higher accuracy.

In a fifth possible implementation form of the parametric audio encoder according to the first aspect or according to any of the preceding implementation forms of the first aspect, the parameter generator is configured to determine the first set of encoding parameters for each frequency bin or for each frequency sub-band of the audio channel signals.

The parametric audio encoder can limit determining the first set of encoding parameters to frequency bins or frequency sub-bands which are perceivable by the human ear and thus save complexity.

In a sixth possible implementation form of the parametric audio encoder according to the first aspect or according to any of the preceding implementation forms of the first aspect, the parameter generator is configured to determine the first encoding parameter average of the audio channel signal as an average of the first set of encoding parameters of the audio channel signal over frequency bins or frequency sub-bands.

By that averaging the parametric audio encoder provides a short-time average of the audio signal where all frequency components are considered.

In a seventh possible implementation form of the parametric audio encoder according to the first aspect or according to any of the preceding implementation forms of the first aspect, the parameter generator is configured to determine the second encoding parameter average of the audio channel signal as an average of a plurality of first encoding parameter averages over a plurality of frames of the audio channel signal, wherein each first encoding parameter average is associated to a frame of the multi-channel audio signal.

By that averaging the parametric audio encoder provides a long-time average of the audio signal where the characteristic properties of the speech signal or of the music signal are considered.

In an eighth possible implementation form of the parametric audio encoder according to the first aspect or according to any of the preceding implementation forms of the first aspect, the parameter generator is configured to determine an absolute value of a difference between the second encoding parameter average and the first encoding parameter average.

By that difference the parametric audio encoder provides a measure for the difference between the long-time average and the short-time average and therefore is able to predict the behavior of the speech or music.

In a ninth possible implementation form of the parametric audio encoder according to the eighth implementation form of the first aspect, the parameter generator is configured to determine the encoding parameter as a function of the determined absolute value.

When the encoding parameter is provided as a function of the determined absolute value, a relation between the encoding parameter and the determined absolute value exists, which may be used to efficiently compute the encoding parameter. The computational complexity is thus reduced.

In a tenth possible implementation form of the parametric audio encoder according to the eighth implementation form or according to the ninth implementation form of the first aspect, the parameter generator is configured to determine the encoding parameter from a difference between a first parameter value and the determined absolute value multiplied by a second parameter value.

When the encoding parameter is provided as a difference between the first parameter value and the determined absolute value, a relation between the encoding parameter and the determined absolute value exists, which may be used to efficiently compute the encoding parameter. The computational complexity is thus reduced.

In an eleventh possible implementation form of the parametric audio encoder according to the tenth implementation form of the first aspect, the parameter generator is configured to set the first parameter value to one and to set the second parameter value to one.

By that relation the parametric audio encoder is able to efficiently compute the encoding parameter. The computational complexity is thus reduced.

In a twelfth possible implementation form of the parametric audio encoder according to the first aspect or according to any of the preceding implementation forms of the first aspect, the parametric audio encoder further comprises a down-mix signal generator for superimposing at least two of the audio channel signals of the multi-channel audio signal to obtain a down-mix signal, an audio encoder, in particular a mono encoder, for encoding the down-mix signal to obtain an encoded audio signal, and a combiner for combining the encoded audio signal with a corresponding encoding parameter.

The down-mix signal and the encoded audio signal can be used as a reference signal for the parameter generator. Both signals include the plurality of audio channel signals and thus provide higher accuracy than a single channel signal taken as reference signal.

In a thirteenth implementation form of the parametric audio encoder according to the first aspect or according to any of the preceding implementation forms of the first aspect, the first encoding parameter average refers to a current frame of the audio channel signal and the other first encoding parameter average refers to a previous frame of the audio channel signal.

By using current and previous frames of the audio channel signal the long-time averaging can be efficiently performed.

In a fourteenth implementation form of the parametric audio encoder according to the thirteenth implementation form of the first aspect, the current frame of the audio channel signal is contiguous to the previous frame of the audio channel signal.

When both frames are contiguous, spikes in the audio channel signals are detected in the average and can be considered in the parametric audio encoder. Thus encoding is more precise than an encoding where spikes cannot be detected.

According to a second aspect, the invention relates to a parametric audio encoder for generating an encoding parameter for an audio channel signal of a plurality of audio channel signals of a multi-channel audio signal, each audio channel signal having audio channel signal values, the parametric audio encoder comprising a parameter generator, the parameter generator being configured to determine for the audio channel signal of the plurality of audio channel signals a first set of encoding parameters from the audio channel signal values of the audio channel signal and reference audio signal values of a reference audio signal, wherein the reference audio signal is a downmix audio signal derived from at least two audio channel signals of the plurality of multi-channel audio signals, to determine for the audio channel signal a first encoding parameter average based on the first set of encoding parameters of the audio channel signal, to determine for the audio channel signal a second encoding parameter average based on the first encoding parameter average of the audio channel signal and at least one other first encoding parameter average of the audio channel signal, and to determine the encoding parameter based on the first encoding parameter average of the audio channel signal and the second encoding parameter average of the audio channel signal.

The reference audio signal can be one of the audio channel signals of the multi-channel audio signal. In particular, the reference audio signal can be either a left or a right audio channel signal of a stereo signal forming an embodiment of a two-channel multi-channel signal. However, the reference audio signal can be any signal forming a reference for determining the encoding parameters. Such reference signal may be formed by a downmix audio signal after downmixing the channels of the multichannel-audio signal, or an output of a mono encoder.

The parametric audio encoder can have a low complexity as it does not require a coherence or correlation computation. It even provides an accurate estimate of the relationship between the audio channels when the ICC is quantized with a rough quantizer requiring only a few steps. Especially for music signals, but also for speech signals, using the encoding parameter for the encoding of the audio signals is important because the output music sounds more natural with the correct sound scene width, and not "dry". For very low bitrate parametric stereo audio coding scheme, the bit budget is limited and only one full band ICC is transmitted, the encoding parameter is able to represent the global correlation between the channels.

In a first possible implementation form of the parametric audio encoder according to the second aspect, the first set of encoding parameters are ones of the following parameters: inter-channel level difference, inter-channel phase difference, inter-channel coherence, inter-channel intensity difference, sub-band inter-channel level difference, sub-band inter-channel phase difference, sub-band inter-channel coherence, and sub-band inter-channel intensity difference.

Such parameters represent a degree of similarity between the audio signals and can thus be used by the encoder for reducing information to be transmitted and thus reducing computational complexity.

In a second possible implementation form of the parametric audio encoder according to the second aspect or according to the first implementation form of the second aspect, the parameter generator is configured to determine phase differences of subsequent audio channel signal values to obtain the first set of encoding parameters.

Phase differences of subsequent audio channel signals are required for reproducing phase and/or delay differences between the channels. When phase differences are reproduced, speech and music sound more natural.

In a third possible implementation form of the parametric audio encoder according to the second aspect or according to any of the preceding implementation forms of the second aspect, the audio channel signal and the reference audio signal are frequency-domain signals, and the audio channel signal values and the reference audio signal values are associated with frequency bins or frequency sub-bands.

The frequency resolution used is largely motivated by the frequency resolution of the auditory system. Psychoacoustics suggests that spatial perception is most likely based on a critical band representation of the acoustic input signal. This frequency resolution is considered by using an invertible filter-bank with sub-bands with bandwidths equal or proportional to the critical bandwidth of the auditory system. Thus, the parametric audio encoder can be well adapted to human perception.

In a fourth possible implementation form of the parametric audio encoder according to the second aspect or according to any of the preceding implementation forms of the second aspect, the parametric audio encoder further comprises a transformer for transforming a plurality of time-domain audio channel signals in frequency domain to obtain the plurality of audio channel signals.

Equalization of the channel impulse response can be efficiently performed in frequency domain as the convolution in time domain is a multiplication in frequency domain. Thus, performing the computations of the parametric audio encoder in frequency domain can result in a higher efficiency with respect to computational complexity or in a higher accuracy.

In a fifth possible implementation form of the parametric audio encoder according to the second aspect or according to any of the preceding implementation forms of the second aspect, the parameter generator is configured to determine the first set of encoding parameters for each frequency bin or for each frequency sub-band of the audio channel signals.

The parametric audio encoder can limit determining the first set of encoding parameters to frequency bins or frequency sub-bands which are perceivable by the human ear and thus save complexity.

In a sixth possible implementation form of the parametric audio encoder according to the second aspect or according to any of the preceding implementation forms of the second aspect, the parameter generator is configured to determine the first encoding parameter average of the audio channel signal as an average of the first set of encoding parameters of the audio channel signal over frequency bins or frequency sub-bands.

By that averaging the parametric audio encoder provides a short-time average of the audio signal where all frequency components are considered.

In a seventh possible implementation form of the parametric audio encoder according to the second aspect or according to any of the preceding implementation forms of the second aspect, the parameter generator is configured to determine the second encoding parameter average of the audio channel signal as an average of a plurality of first encoding parameter averages over a plurality of frames of the audio channel signal, wherein each first encoding parameter average is associated to a frame of the multi-channel audio signal.

By that averaging the parametric audio encoder provides a long-time average of the audio signal where the characteristic properties of the speech signal or of the music signal are considered.

In an eighth possible implementation form of the parametric audio encoder according to the second aspect or according to any of the preceding implementation forms of the second aspect, the parameter generator is configured to determine an absolute value of a difference between the second encoding parameter average and the first encoding parameter average.

By that difference the parametric audio encoder provides a measure for the difference between the long-time average and the short-time average and therefore is able to predict the behavior of the speech or music.

In a ninth possible implementation form of the parametric audio encoder according to the eighth implementation form of the second aspect, the parameter generator is configured to determine the encoding parameter as a function of the determined absolute value.

When the encoding parameter is provided as a function of the determined absolute value, a relation between the encoding parameter and the determined absolute value exists, which may be used to efficiently compute the encoding parameter. The computational complexity is thus reduced.

In a tenth possible implementation form of the parametric audio encoder according to the eighth implementation form or according to the ninth implementation form of the second aspect, the parameter generator is configured to determine the encoding parameter from a difference between a first parameter value and the determined absolute value multiplied by a second parameter value.

When the encoding parameter is provided as a difference between the first parameter value and the determined absolute value, a relation between the encoding parameter and the determined absolute value exists, which may be used to efficiently compute the encoding parameter. The computational complexity is thus reduced.

In an eleventh possible implementation form of the parametric audio encoder according to the tenth implementation form of the second aspect, the parameter generator is configured to set the first parameter value to one and to set the second parameter value to one.

By that relation the parametric audio encoder is able to efficiently compute the encoding parameter. The computational complexity is thus reduced.

In a twelfth possible implementation form of the parametric audio encoder according to the second aspect or according to any of the preceding implementation forms of the second aspect, the parametric audio encoder further comprises a down-mix signal generator for superimposing at least two of the audio channel signals of the multi-channel audio signal to obtain a down-mix signal, an audio encoder, in particular a mono encoder, for encoding the down-mix signal to obtain an encoded audio signal, and a combiner for combining the encoded audio signal with a corresponding encoding parameter.

The down-mix signal and the encoded audio signal can be used as a reference signal for the parameter generator. Both signals include the plurality of audio channel signals and thus provide higher accuracy than a single channel signal taken as reference signal.

In a thirteenth implementation form of the parametric audio encoder according to the second aspect or according to any of the preceding implementation forms of the second aspect, the first encoding parameter average refers to a current frame of the audio channel signal and the other first encoding parameter average refers to a previous frame of the audio channel signal.

By using current and previous frames of the audio channel signal the long-time averaging can be efficiently performed.

In a fourteenth implementation form of the parametric audio encoder according to the thirteenth implementation form of the second aspect, the current frame of the audio channel signal is contiguous to the previous frame of the audio channel signal.

When both frames are contiguous, spikes in the audio channel signals are detected in the average and can be considered in the parametric audio encoder. Thus encoding is more precise than an encoding where spikes cannot be detected.

According to a third aspect, the invention relates to a method for generating an encoding parameter for an audio channel signal of a plurality of audio channel signals of a multi-channel audio signal, each audio channel signal having audio channel signal values, the method comprising:

determining for the audio channel signal of the plurality of audio channel signals a first set of encoding parameters from the audio channel signal values of the audio channel signal and reference audio signal values of a reference audio signal, wherein the reference audio signal is another audio channel signal of the plurality of audio channel signals, determining for the audio channel signal a first encoding parameter average based on the first set of encoding parameters of the audio channel signal, determining for the audio channel signal a second encoding parameter average based on the first encoding parameter average of the audio channel signal and at least one other first encoding parameter average of the audio channel signal, and determining the encoding parameter based on the first encoding parameter average of the audio channel signal and the second encoding parameter average of the audio channel signal.

The method may be efficiently performed on a processor.

The reference audio signal can be one of the audio channel signals of the multi-channel audio signal. In particular, the reference audio signal can be either a left or a right audio channel signal of a stereo signal forming an embodiment of a two-channel multi-channel signal. However, the reference audio signal can be any signal forming a reference for determining the encoding parameters. Such reference signal may be formed by a mono downmix audio signal after downmixing the channels of the multichannel-audio signal, or one of the channel of a downmix audio signal after downmixing the channels of the multichannel-audio signal.

According to a fourth aspect, the invention relates to a method for generating an encoding parameter for an audio channel signal of a plurality of audio channel signals of a multi-channel audio signal, each audio channel signal having audio channel signal values, the method comprising:

determining for the audio channel signal of the plurality of audio channel signals a first set of encoding parameters from the audio channel signal values of the audio channel signal and reference audio signal values of a reference audio signal, wherein the reference audio signal is a down-mix audio signal derived from at least two audio channel signals of the plurality of multi-channel audio signals, determining for the audio channel signal a first encoding parameter average based on the first set of encoding parameters of the audio channel signal, determining for the audio channel signal a second encoding parameter average based on the first encoding parameter average of the audio channel signal and at least one other first encoding parameter average of the audio channel signal, and determining the encoding parameter based on the first encoding parameter average of the audio channel signal and the second encoding parameter average of the audio channel signal.

The method may be efficiently performed on a processor.

The reference audio signal can be one of the audio channel signals of the multi-channel audio signal. In particular, the reference audio signal can be either a left or a right audio channel signal of a stereo signal forming an embodiment of a two-channel multi-channel signal. However, the reference audio signal can be any signal forming a reference for determining the encoding parameters. Such reference signal may be formed by a mono downmix audio signal after downmixing the channels of the multichannel-audio signal, or one of the channels of a downmix audio signal after downmixing the channels of the multichannel-audio signal.

According to a fifth aspect, the invention relates to a computer program being configured to implement the method according to one of the third and fourth aspects of the invention when executed on a computer.

The computer program has reduced complexity and can thus be efficiently implemented in mobile terminal where the battery life must be saved. Battery life time is increased when the computer program runs on a mobile terminal.

The methods described herein may be implemented as software in a Digital Signal Processor (DSP), in a microcontroller or in any other side-processor or as hardware circuit within an application specific integrated circuit (ASIC).

The invention can be implemented in digital electronic circuitry, or in computer hardware, firmware, software, or in combinations thereof.

BRIEF DESCRIPTION OF THE DRAWINGS

Further embodiments of the invention will be described with respect to the following figures, in which.

DETAILED DESCRIPTION

Figure 1:
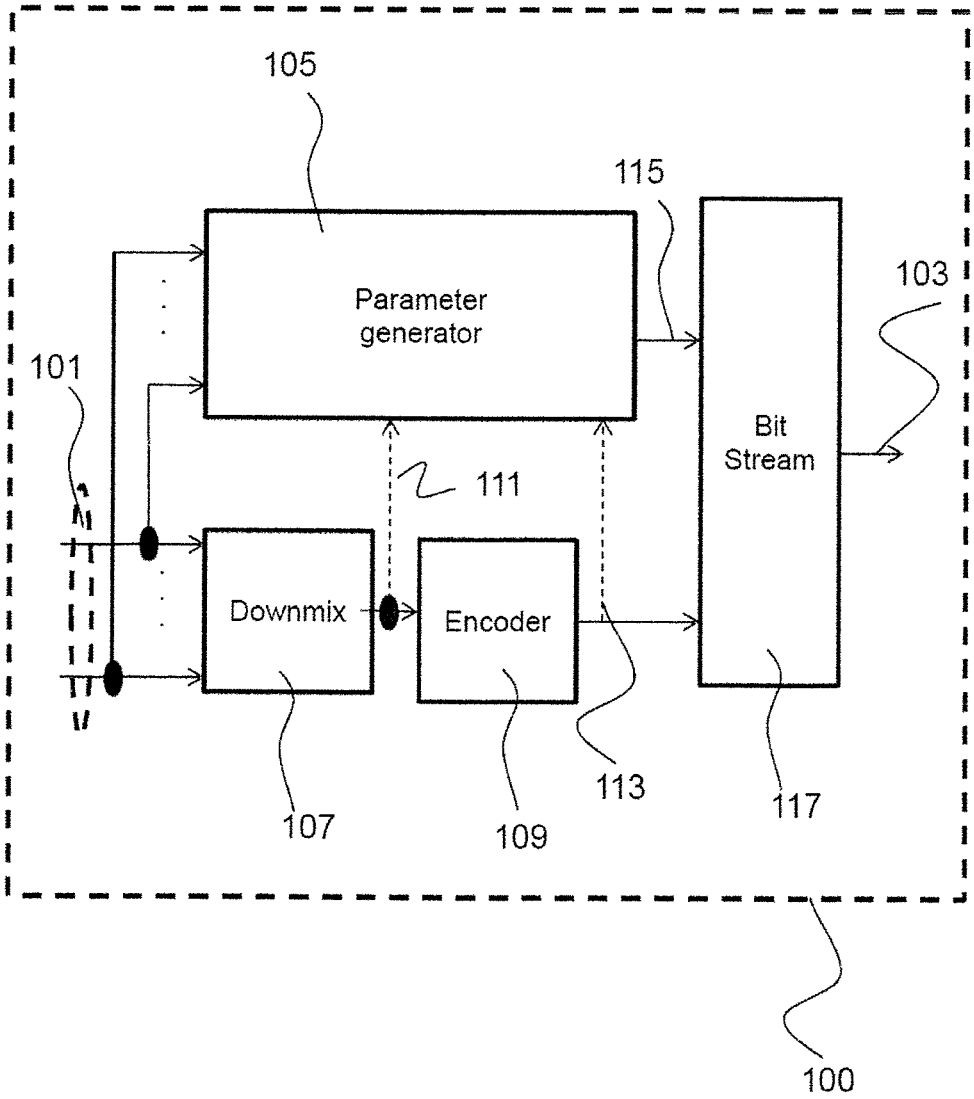
FIG. 1 shows a block diagram of a parametric audio encoder according to an implementation form.

FIG. 1 shows a block diagram of a parametric audio encoder 100 according to an implementation form. The parametric audio encoder 100 receives a multi-channel audio signal 101 as input signal and provides a bit stream as output signal 103. The parametric audio encoder 100 comprises a parameter generator 105 coupled to the multi-channel audio signal 101 for generating an encoding parameter 115, a down-mix signal generator 107 coupled to the multi-channel audio signal 101 for generating a down-mix signal 111 or sum signal, an audio encoder 109 coupled to the down-mix signal generator 107 for encoding the down-mix signal 111 to provide an encoded audio signal 113 and a combiner 117, e.g. a bit stream former coupled to the parameter generator 105 and the audio encoder 109 to form a bit stream 103 from the encoding parameter 115 and the encoded signal 113.

The parametric audio encoder 100 implements an audio coding scheme for stereo and multi-channel audio signals, which only transmits one single audio channel, e.g., the downmix audio channel plus additional parameters describing "perceptually relevant differences" between the audio channels $X_1[b], X_2[b], \ldots, X_M[b]$. The coding scheme is according to binaural cue coding (BCC) because binaural cues play an important role in it. As indicated in the figure, the plurality M of input audio channels $X_1[b], X_2[b], \ldots, X_M[b]$ of the multi-channel audio signal 101 are down-mixed to one single audio channel 111, also denoted as the sum signal. For a stereo audio signal M equals 2. As "perceptually relevant differences" between the audio channels $X_1[b], X_2[b], \ldots, X_M[b]$, the encoding parameter 115, e.g., an inter-channel time difference (ICTD), an inter-channel level difference (ICLD), and/or an inter-channel coherence (ICC), is estimated as a function of frequency and time and transmitted as side information to the decoder 200 described in FIG. 2.

The parameter generator 105 implementing BCC processes the multi-channel audio signal 101 with a certain time and frequency resolution. The frequency resolution used is largely motivated by the frequency resolution of the auditory system. Psychoacoustics suggests that spatial perception is most likely based on a critical band representation of the acoustic input signal. This frequency resolution is considered by using an invertible filter-bank with sub-bands with bandwidths equal or proportional to the critical bandwidth of the auditory system. It is important that the transmitted sum signal 111 contains all signal components of the multi-channel audio signal 101. The goal is that each signal component is fully maintained. Simple summation of the audio input channels $X_1[b], X_2[b], \ldots, X_M[b]$ of the multi-channel audio signal 101 often results in amplification or attenuation of signal components. In other words, the power of signal components in the "simple" sum is often larger or smaller than the sum of the power of the corresponding signal component of each channel $X_1[b], X_2[b], \ldots, X_M[b]$. Therefore, a down-mixing technique is used by applying the down-mixing device 107 which equalizes the sum signal 111 such that the power of signal components in the sum signal 111 is approximately the same as the corresponding power in all input audio channels $X_1[b], X_2[b], \ldots, X_M[b]$ of the multi-channel audio signal 101. The input audio channels $X_1[b], X_2[b], \ldots, X_M[b]$ represent the channel signals for sub-band b. Frequency domain input audio channel is denoted $X_1[k], X_2[k], \ldots, X_M[k]$ where k represents the frequency index (frequency bin), a sub-band b being usually composed of several frequency bins k.

Given the sum signal 111, the parameter generator 105 synthesizes a stereo or multi-channel audio signal 115 such that ICTD, ICLD, and/or ICC approximate the corresponding cues of the original multi-channel audio signal 101.

When considering binaural room impulse responses (BRIRs) of one source, there is a relationship between width of the auditory event and listener envelopment and IC estimated for the early and late parts of the BRIRs. However, the relationship between IC (or ICC) and these properties for general signals (and not just the BRIRs) is not straightforward. Stereo and multi-channel audio signals usually contain a complex mix of concurrently active source signals superimposed by reflected signal components resulting from recording in enclosed spaces or added by the recording engineer for artificially creating a spatial impression. Different source signals and their reflections occupy different regions in the time-frequency plane. This is reflected by ICTD, ICLD, and ICC which vary as a function of time and frequency. In this case, the relation between instantaneous ICTD, ICLD, and ICC and auditory event directions and spatial impression is not obvious. The strategy of the parameter generator 105 is to blindly synthesize these cues such that they approximate the corresponding cues of the original audio signal.

In an implementation form, the parametric audio encoder 100 uses filter-banks with sub-bands of bandwidths equal to two times the equivalent rectangular bandwidth. Informal listening revealed that the audio quality of BCC did not notably improve when choosing higher frequency resolution. A lower frequency resolution is favorable since it results in less ICTD, ICLD, and ICC values that need to be transmitted to the decoder and thus in a lower bitrate. Regarding time-resolution, ICTD, ICLD, and ICC are considered at regular time intervals. In an implementation form ICTD, ICLD, and ICC are considered about every 4-16 ms. Note that unless the cues are considered at very short time intervals, the precedence effect is not directly considered.

Figure 4:
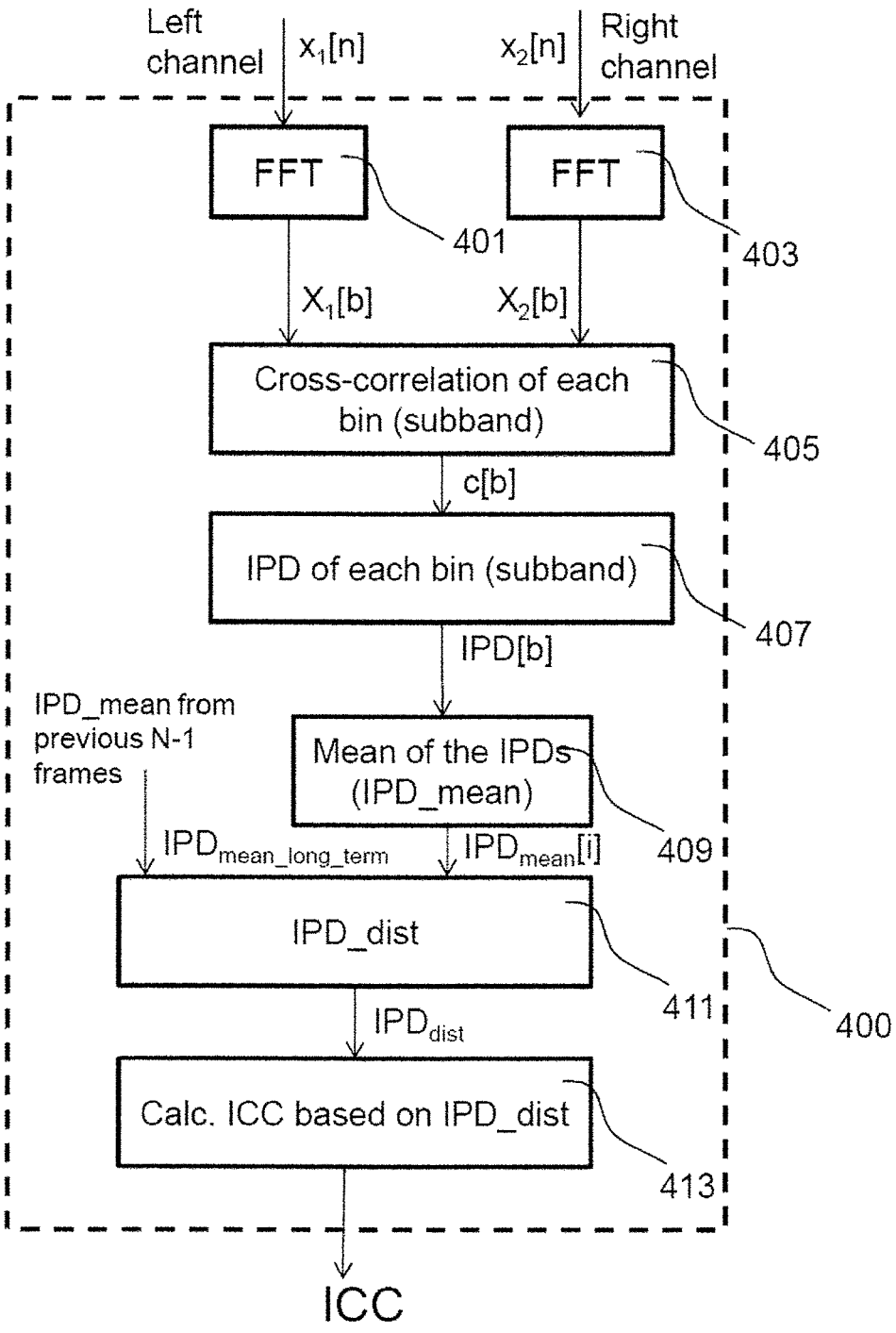
FIG. 4 shows a schematic diagram of a method for generating an encoding parameter for an audio channel signal according to an implementation form.

The often achieved perceptually small difference between reference signal and synthesized signal implies that cues related to a wide range of auditory spatial image attributes are implicitly considered by synthesizing ICTD, ICLD, and ICC at regular time intervals. The bitrate required for transmission of these spatial cues is just a few kb/s and thus the parametric audio encoder 100 is able to transmit stereo and multi-channel audio signals at bitrates close to what is required for a single audio channel. FIG. 4 illustrates a method in which ICC is estimated as the encoding parameter 115.

The parametric audio encoder 100 comprises the down-mix signal generator 107 for superimposing at least two of the audio channel signals of the multi-channel audio signal 101 to obtain the down-mix signal 111, the audio encoder 109, in particular a mono encoder, for encoding the down-mix signal 111 to obtain the encoded audio signal 113, and the combiner 117 for combining the encoded audio signal 113 with a corresponding encoding parameter 115.

The parametric audio encoder 100 generates the encoding parameter 115 for one audio channel signal of the plurality of audio channel signals denoted as $X_1[b], X_2[b], \ldots, X_M[b]$ of the multi-channel audio signal 101. Each of the audio channel signals $X_1[b], X_2[b], \ldots, X_M[b]$ may be a digital signal comprising digital audio channel signal values in frequency domain denoted as $X_1[k], \ldots, X_2[k], \ldots, X_M[k]$.

An exemplary audio channel signal for which the parametric audio encoder 100 generates the encoding parameter 115 is the first audio channel signal $X_1[b]$ with signal values $X_1[k]$. The parameter generator 105 determines for the audio channel signal $X_1[b]$ a first set of encoding parameters denoted as IPD[b] from the audio channel signal values $X_1[k]$ of the audio channel signal $X_1[b]$ and from reference audio signal values of a reference audio signal.

An audio channel signal which is used as a reference audio signal is the second audio channel signal $X_2[b]$, for example. Similarly any other one of the audio channel signals $X_1[b], X_2[b], \ldots, X_M[b]$ may serve as reference audio signal. According to a first aspect, the reference audio signal is another audio channel signal of the audio channel signals which is not equal to the audio channel signal $X_1[b]$ for which the encoding parameter 115 is generated.

According to a second aspect, the reference audio signal is a down-mix audio signal derived from at least two audio channel signals of the plurality of multi-channel audio signals 101, e.g. derived from the first audio channel signal $X_1[b]$ and the second audio channel signal $X_2[b]$. In an implementation form, the reference audio signal is the down-mix signal 111, also called sum signal generated by the down-mixing device 107. In an implementation form, the reference audio signal is the encoded signal 113 provided by the encoder 109.

An exemplary reference audio signal used by the parameter generator 105 is the second audio channel signal $X_2[b]$ with signal values X2[k].

The parameter generator 105 determines for the audio channel signal $X_1[b]$ a first encoding parameter average, denoted as $IPD_{mean}[i]$ based on the first set of encoding parameters IPD[b] of the audio channel signal $X_1[b]$.

The parameter generator 105 determines for the audio channel signal $X_1[b]$ a second encoding parameter average, denoted as $IPD_{mean_long_term}$, based on the first encoding parameter average $IPD_{mean}[i]$ of the audio channel signal $X_1[b]$ and at least one other first encoding parameter average, denoted as $IPD_{mean}[i-1]$ of the audio channel signal $X_1[b]$.

In an implementation form, the first encoding parameter average $IPD_{mean}[i]$ refers to a current frame i of the audio channel signal $X_1[b]$ and the other first encoding parameter average $IPD_{mean}[i-1]$ refers to a previous frame i−1 of the audio channel signal $X_1[b]$. In an implementation form, the previous frame i−1 of the audio channel signal $X_1[b]$ is the frame i−1 received prior to the current frame i with no other frame in between. In an implementation form, the previous frame i-N of the audio channel signal $X_1[b]$ is a frame i-N received prior to the current frame i but multiple frames have been arrived in between.

The parameter generator 105 determines the encoding parameter 115, denoted as ICC, based on the first encoding parameter average $IPD_{mean}[i]$ of the audio channel signal $X_1[b]$ and based on the second encoding parameter average $IPD_{mean_long_term}$ of the audio channel signal $X_1[b]$.

The first set of encoding parameters IPD[b] are inter-channel phase differences, inter channel level differences, inter-channel coherences, inter-channel intensity differences, sub-band inter-channel level differences, sub-band inter-channel phase differences, sub-band inter-channel coherences, sub-band inter-channel intensity differences, or combinations thereof. An inter-channel phase difference (ICPD) is an average phase difference between a signal pair. An inter-channel level difference (ICLD) is the same as an interaural level difference (ILD), i.e. a level difference between left and right ear entrance signals, but defined more generally between any signal pair, e.g. a loudspeaker signal pair, an ear entrance signal pair, etc. An inter-channel coherence or an inter-channel correlation is the same as an inter-aural coherence (IC), i.e. the degree of similarity between left and right ear entrance signals, but defined more generally between any signal pair, e.g. loudspeaker signal pair, ear entrance signal pair, etc. An inter-channel time difference (ICTD) is the same as an interaural time difference (ITD), sometimes also referred to as interaural time delay, i.e. a time difference between left and right ear entrance signals, but defined more generally between any signal pair, e.g. loudspeaker signal pair, ear entrance signal pair, etc. The sub-band inter-channel level differences, sub-band inter-channel phase differences, sub-band inter-channel coherences and sub-band inter-channel intensity differences are related to the parameters specified above with respect to the sub-band bandwidth.

The parameter generator 101 determines phase differences of subsequent audio channel signal values $X_1[k]$ to obtain the first set of encoding parameters IPD[b]. In an implementation form, the audio channel signal $X_1[b]$ and the reference audio signal $X_2[b]$ are frequency-domain signals and the audio channel signal values $X_1[k]$ and the reference audio signal values $X_2[k]$ are associated with frequency bins denoted as [k], or frequency sub-bands, denoted as [b]. In an implementation form, the parametric audio encoder 100 comprises a transformer, e.g. an FFT device for transforming a plurality of time-domain audio channel signals $X_1[n]$, $X_2[n]$ in frequency domain to obtain the plurality of audio channel signals $X_1[b]$, $X_2[b]$. In an implementation form, the parameter generator 101 determines the first set of encoding parameters IPD[b] for each frequency bin [k] or for each frequency subband [b] of the audio channel signals $X_1[b]$, $X_2[b]$.

In a first step, the parameter generator 105 applies a time frequency transform on the time-domain input channel, e.g. the first input channel $x_1[n]$ and the time-domain reference channel, e.g. the second input channel $x_2[n]$. In case of stereo these are the left and right channels. In a preferred embodiment, the time frequency transform is a Fast Fourier Transform (FFT). In alternative embodiment, the time frequency transform is a cosine modulated filter bank or a complex filter bank.

In a second step, the parameter generator 105 computes a cross-spectrum for each frequency bin [b] of the FFT as:

$c[b]=X_1[b]X_2^*[b]$, where c [b] is the cross-spectrum of frequency bin [b] and $X_1[b]$ and $X_2[b]$ are the FFT coefficients of the two channels, and * denotes complex conjugation. For this case, a sub-band [b] corresponds directly to one frequency bin [k], frequency bin [b] and [k] represent exactly the same frequency bin.

Alternatively, the parameter generator 105 computes the cross-spectrum per sub-band [b] as:

$c[b]=\Sigma_{k=k_b}^{k_{b+1}-1}X_1[k]X_2^*[k]$, where c[b] is the cross-spectrum of sub-band [b] and $X_1[k]$ and $X_2[k]$ are the FFT coefficients of the two channels, and * denotes complex conjugation. $k_b$ is the start bin of sub-band b and $k_{b+1}$ is the start bin of the adjacent sub-band b+1. Hence, the frequency bins [k] of the FFT between $k_b$ and $k_{b+1}-1$ represent the sub-bands [b].

The inter channel phase differences (IPDs) are calculated per sub-band based on the cross-spectrum as:

$$IPD[b]=\angle c[b]$$

where the operation a?? is the argument operator to compute the angle of c[b].

In an implementation form, the parameter generator 101 determines the first encoding parameter average $IPD_{mean}[i]$ of the audio channel signal $X_1[b]$ as an average of the first set of encoding parameters IPD[b] of the audio channel signal $X_1[b]$ over frequency bins [b] or frequency sub-bands [b].

The averaged IPD ($IPD_{mean}$), over the frequency bins [b] or frequency sub-bands [b] is computed as defined in the following equation:

$$IPD_{mean}=\frac{\sum_{k=1}^{K}IPD[k]}{K}$$

where K is the number of the frequency bins or frequency sub-bands which are taken into account for the computation of the average.

In an implementation form, the parameter generator 101 determines the second encoding parameter average $IPD_{mean_long_term}$ of the audio channel signal $X_1[b]$ as an average of a plurality of first encoding parameter averages $IPD_{mean}[i]$ over a plurality of frames of the audio channel signal $X_1[b]$, wherein each first encoding parameter average $IPD_{mean}[i]$ is associated to a frame [i] of the multi-channel audio signal.

Based on the previously computed $IPD_{mean}$ the parameter generator 105 calculates a long term average of the IPD. The $IPD_{mean_long_term}$ is computed as the average over the last N frames (for instance N can be set to 10).

$$IPD_{mean_long_term}=\frac{\sum_{i=1}^{N}IPD_{mean}[i]}{N}$$

In an implementation form, the parameter generator 101 determines an absolute value $IPD_{dist}$ of a difference between the second encoding parameter average $IPD_{mean_long_term}$ and the first encoding parameter average $IPD_{mean}[i]$.

In order to evaluate the stability of the IPD parameter, the distance between $IPD_{mean}$ and $IPD_{mean_long_term}$ ($IPD_{dist}$) is computed, which shows the evolution of the IPD during the last N frames. In a preferred embodiment, the distance between the local and long term IPD is calculated as the absolute value of the difference between the local and the long term average:

$$IPD_{dist}=abs(IPD_{mean}-IPD_{mean_long_term})$$

It can be seen that if the $IPD_{mean}$ parameter is stable over the previous frames, the distance $IPD_{dist}$ becomes close to 0. The distance is then equal to zero when the phase difference is stable over the time. This distance gives a good estimation of the similarity of the channels.

In an implementation form, the parameter generator 101 determines the encoding parameter ICC as a function of the determined absolute value $IPD_{dist}$. In an implementation form, the parameter generator 101 determines the encoding parameter ICC from a difference between a first parameter value d and the determined absolute value $IPD_{dist}$ multiplied by a second parameter value e. In an implementation form, the parameter generator 101 sets the first parameter value d to one and sets the second parameter value e to one.

The coherence or ICC parameter is calculated as $ICC=1-IPD_{dist}$, since ICC and $IPD_{dist}$ have an indirect inverse relation. ICC is close to 1 when the channels are similar and $IPD_{dist}$ becomes equal to 0 in that case.

Alternatively, the equation to define the relation between ICC and $IPD_{dist}$ is defined as $ICC=d-e.IPD_{dist}$ with d and e being chosen to better represent the inverse relation between the two parameters. In a further embodiment, the relation between ICC and $IPD_{dist}$ is obtained by training over a large database and is then generalized as $ICC=f(IPD_{dist})$.

During correlated segment of audio signal (for instance for speech signal), the $IPD_{dist}$ is small and during diffuse parts of the audio input (for instance for music signal), this $IPD_{dist}$ parameter becomes much bigger and will be close to 1 if the input channels are decorrelated. Thus, ICC and $IPD_{dist}$ have an indirect inverse relation.

Figure 2:
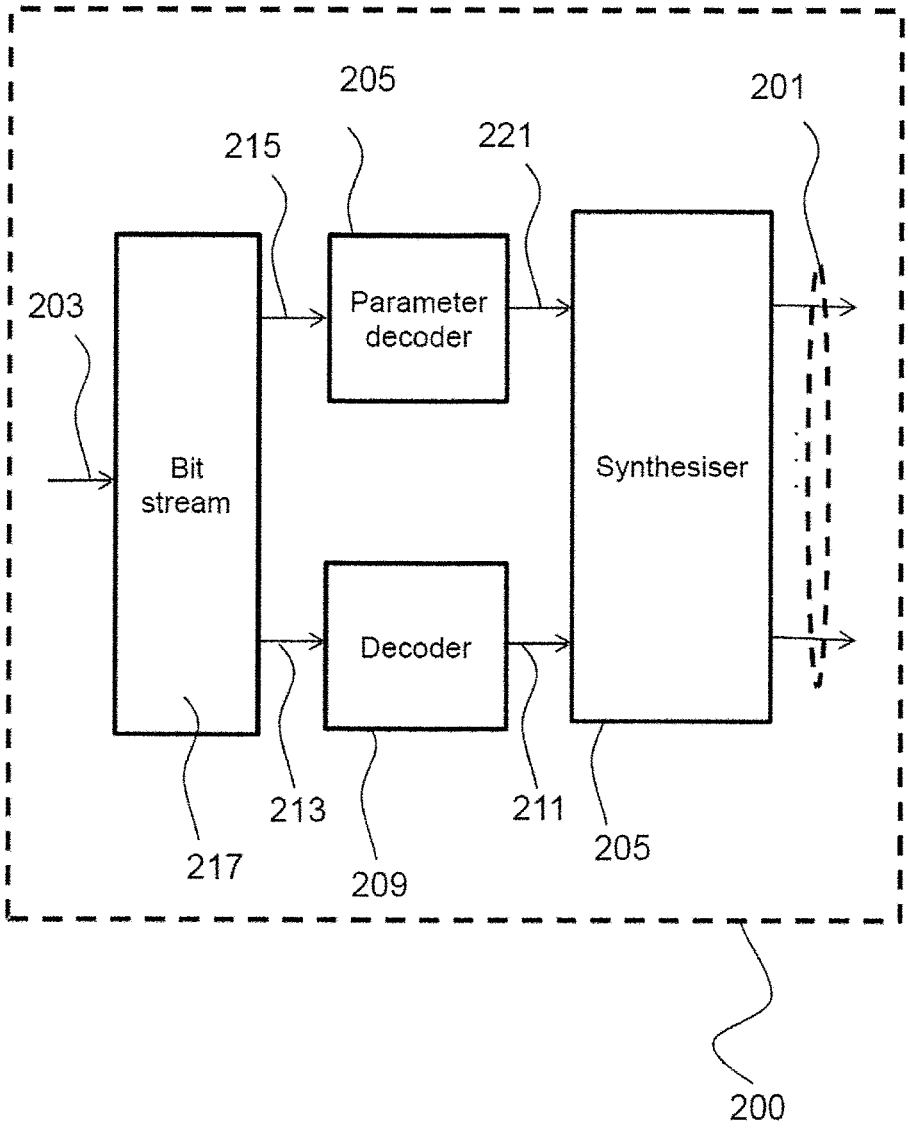
FIG. 2 shows a block diagram of a parametric audio decoder according to an implementation form.

FIG. 2 shows a block diagram of a parametric audio decoder 200 according to an implementation form. The parametric audio decoder 200 receives a bit stream 203 transmitted over a communication channel as input signal and provides a decoded multi-channel audio signal 201 as output signal. The parametric audio decoder 200 comprises a bit stream decoder 217 coupled to the bit stream 203 for decoding the bit stream 203 into an encoding parameter 215 and an encoded signal 213, a decoder 209 coupled to the bit stream decoder 217 for generating a sum signal 211 from the encoded signal 213, a parameter decoder 205 coupled to the bit stream decoder 217 for decoding a parameter 221 from the encoding parameter 215 and a synthesizer 205 coupled to the parameter decoder 205 and the decoder 209 for synthesizing the decoded multi-channel audio signal 201 from the parameter 221 and the sum signal 211.

The parametric audio decoder 200 generates the output channels of its multi-channel audio signal 201 such that ICTD, ICLD, and/or ICC between the channels approximate those of the original multi-channel audio signal. The described scheme is able to represent multi-channel audio signals at a bitrate only slightly higher than what is required to represent a mono audio signal. This is so, because the estimated ICTD, ICLD, and ICC between a channel pair contain about two orders of magnitude less information than an audio waveform. Not only the low bitrate but also the backwards compatibility aspect is of interest. The transmitted sum signal corresponds to a mono down-mix of the stereo or multi-channel signal.

Figure 3:
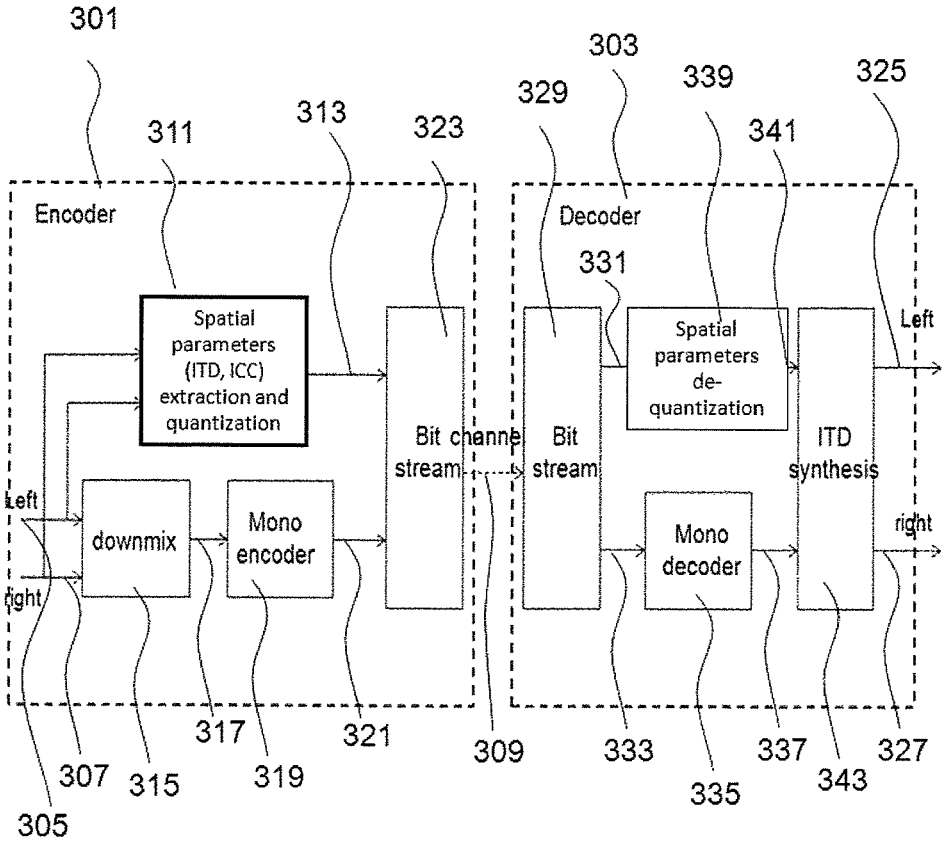
FIG. 3 shows a block diagram of a parametric stereo audio encoder and decoder according to an implementation form.

FIG. 3 shows a block diagram of a parametric stereo audio encoder 301 and decoder 303 according to an implementation form. The parametric stereo audio encoder 301 corresponds to the parametric audio encoder 100 as described with respect to FIG. 1, but the multi-channel audio signal 101 is a stereo audio signal with a left 305 and a right 307 audio channels.

The parametric stereo audio encoder 301 receives the stereo audio signal 305, 307, comprising a left channel audio signal 305 and a right channel audio signal 307, as input signal and provides a bit stream as output signal 309. The parametric stereo audio encoder 301 comprises a parameter generator 311 coupled to the stereo audio signal 305, 307 for generating spatial parameters 313, a down-mix signal generator 315 coupled to the stereo audio signal 305, 307 for generating a down-mix signal 317 or sum signal, a mono encoder 319 coupled to the down-mix signal generator 315 for encoding the down-mix signal 317 to provide an encoded audio signal 321 and a bit stream combiner 323 coupled to the parameter generator 311 and the mono encoder 319 to combine the encoding parameter 313 and the encoded audio signal 321 to a bit stream to provide the output signal 309. In the parameter generator 311 the spatial parameters 313 are extracted and quantized before being multiplexed in the bit stream.

The parametric stereo audio decoder 303 receives the bit stream, i.e. the output signal 309 of the parametric stereo audio encoder 301 transmitted over a communication channel, as an input signal and provides a decoded stereo audio signal with left channel 325 and right channel 327 as output signal. The parametric stereo audio decoder 303 comprises a bit stream decoder 329 coupled to the received bit stream 309 for decoding the bit stream 309 into encoding parameters 331 and an encoded signal 333, a mono decoder 335 coupled to the bit stream decoder 329 for generating a sum signal 337 from the encoded signal 333, a spatial parameter decoder 339 coupled to the bit stream decoder 329 for decoding spatial parameters 341 from the encoding parameters 331 and a synthesizer 343 coupled to the spatial parameter decoder or resolver 339 and the mono decoder 335 for synthesizing the decoded stereo audio signal 325, 327 from the spatial parameters 341 and the sum signal 337.

The processing in the parametric stereo audio encoder 301 is able to extract delays and compute the level of the audio signals adaptively in time and frequency to generate the spatial parameters 313, e.g., inter-channel time differences (ICTDs) and inter-channel level differences (ICLDs). Furthermore, the parametric stereo audio encoder 301 performs time adaptive filtering efficiently for inter-channel coherence (ICC) synthesis. In an implementation form, the parametric stereo encoder uses a short time Fourier transform (STFT) based filter-bank for efficiently implementing binaural cue coding (BCC) schemes with low computational complexity. The processing in the parametric stereo audio encoder 301 has low computational complexity and low delay, making parametric stereo audio coding suitable for affordable implementation on microprocessors or digital signal processors for real-time applications.

The parameter generator 311 depicted in FIG. 3 is functionally the same as the corresponding parameter generator 105 described with respect to FIG. 1, except that quantization and coding of the spatial cues has been added for illustration. The sum signal 317 is coded with a conventional mono audio coder 319. In an implementation form, the parametric stereo audio encoder 301 uses an STFT-based time-frequency transform to transform the stereo audio channel signal 305, 307 in frequency domain. The STFT applies a discrete Fourier transform (DFT) to windowed portions of an input signal x(n). A signal frame of N samples is multiplied with a window of length W before an N-point DFT is applied. Adjacent windows are overlapping and are shifted by W/2 samples. The window is chosen such that the overlapping windows add up to a constant value of 1. Therefore, for the inverse transform there is no need for additional windowing. A plain inverse DFT of size N with time advance of successive frames of W/2 samples is used in the decoder 303. If the spectrum is not modified, perfect reconstruction is achieved by overlap/add.

As the uniform spectral resolution of the STFT is not well adapted to human perception, the uniformly spaced spectral coefficients output of the STFT are grouped into B non-overlapping partitions with bandwidths better adapted to perception. One partition conceptually corresponds to one "sub-band" according to the description with respect to FIG. 1. In an alternative implementation form, the parametric stereo audio encoder 301 uses a non-uniform filter-bank to transform the stereo audio channel signal 305, 307 in frequency domain.

In an implementation form, the down-mixer 315 determines the spectral coefficients of one partition b or of one sub-band b of the equalized sum signal $S_m(k)$ 317 by $$S_m(k) = \epsilon_b(k)\sum_{c=1}^{C} X_{c,m}(k). \quad \text{i}$$

where $X_{c,m}(k)$ are the spectra of the input audio channels 305, 307 and $e_b(k)$ is a gain factor computed as $$\epsilon_b(k) = \sqrt{\frac{\sum_{c=1}^{C} p_{\hat{x}_{c,b}}(k)}{p_{\hat{x}_b}(k)}}. \quad \text{ii}$$

with partition power estimates, $$p_{\hat{x}_{c,b}}(k) = \sum_{m=A_{b-1}}^{A_b-1} |X_{c,m}(k)|^2$$

$$p_{\hat{x}_b}(k) = \sum_{m=A_{b-1}}^{A_b-1} \left|\sum_{c=1}^{C} X_{c,m}(k)\right|^2.$$

To prevent artifacts resulting from large gain factors when attenuation of the sum of the sub-band signals is significant, the gain factors $e_b(k)$ may be limited to 6 dB, i.e., $e_b(k) \leq 2$.

In an implementation form, the parameter generator 311 applies a time frequency transform, e.g., the STFT as described above or an FFT on the input channels, i.e., on the left 305 and right 307 channel. In an implementation form, the time frequency transform is a Fast Fourier Transform (FFT). In alternative implementation form, the time frequency transform is a cosine modulated filter bank or a complex filter bank.

The parameter generator 311 computes a cross-spectrum for each frequency bin [b] of the FFT or of the STFT as $c[b]=X_1[b]X_2^*[b]$.

For this case, a sub-band [b] corresponds directly to one frequency bin [k], frequency bin [b] and [k] represent exactly the same frequency bin.

Alternatively, the parameter generator 311 computes the cross-spectrum per sub-band [k] as $c[b]=\Sigma_{k=k_b}^{k_{b+1}-1} X_1[k]X_2^*[k]$ where c[b] is the cross-spectrum of bin b or sub-band k. $X_1[k]$ and $X_2[k]$ are the FFT coefficients of the left channel 305 and the right channel 307. The operator * denotes complex conjugation. $k_b$ is the start bin of sub-band k and $k_{b+1}$ is the start bin of the adjacent sub-band b+1. Hence, the frequency bins [k] of the FFT or STFT between $k_b$ and $k_{b+1}-1$ represent the sub-bands [b].

The inter channel phase differences (IPDs) are calculated per sub band based on the cross-spectrum as:

$$IPD[b]=\angle c[b]$$

where the operation a?? is the argument operator to compute the angle of c[b].

In the following, the parameter generator 311 computes the averaged IPD ($IPD_{mean}$) over the frequency bins or frequency sub-bands as defined in the following equation:

$$IPD_{mean} = \frac{\sum_{k=1}^{K} IPD[k]}{K}$$

where K is the number of the frequency bins or frequency sub bands which are taken into account for the computation of the average.

Then, based on the previously computed $IPD_{mean}$, the parameter generator 311 calculates a long term average of the IPD. The $IPD_{mean_long_term}$ is computed as the average over the last N frames, in an implementation form, N is set to 10.

$$IPD_{mean_long_term} = \frac{\sum_{i=1}^{N} IPD_{mean}[i]}{N}$$

In order to evaluate the stability of the IPD parameter, the parameter generator 311 computes the distance $IPD_{dist}$ between $IPD_{mean}$ and $IPD_{mean_long_term}$, which shows the evolution of the IPD during the last N frames. In an implementation form, the distance between the local and long term IPD is calculated as the absolute value of the difference between the local and the long term average:

$$IPD_{dist}=abs(IPD_{mean}-IPD_{mean_long_term})$$

It can be seen that if the $IPD_{mean}$ parameter is stable over the previous frames, the distance $IPD_{dist}$ becomes close to 0. The distance is then equal to zero when the phase difference is stable over the time. This distance gives a good estimation of the similarity of the channels.

In an implementation form, the parameter generator 311 computes the coherence or ICC parameter as $ICC=1-IPD_{dist}$, since ICC and $IPD_{dist}$ have an indirect inverse relation. ICC is close to 1 when the channels are similar and $IPD_{dist}$ becomes equal to 0 in that case.

Alternatively, the parameter generator 311 uses the relation between ICC and $IPD_{dist}$ defined as $ICC=d-e.IPD_{dist}$ with d and e being parameters chosen to better represent the inverse relation between the two parameters ICC and $IPD_{dist}$. In an alternative implementation form, the parameter generator 311 obtains the relation between ICC and $IPD_{dist}$ by training over a large database which is generalized as $ICC=f(IPD_{dist})$.

During a correlated segment of an audio signal, for instance for speech signal, the $IPD_{dist}$ is small and during diffuse parts of the audio input, for instance for music signal, this $IPD_{dist}$ parameter becomes much bigger and will be close to 1 if the input channels are decorrelated. Thus, ICC and $IPD_{dist}$ have an indirect inverse relation.

The parameter generator 311 uses $IPD_{dist}$ to roughly estimate the ICC. The cross-spectrum requires a lower complexity than the correlation calculation. Moreover, in case of computation of the IPD in the parametric spatial audio encoder, this cross spectrum is already computed and the total complexity is then reduced.

FIG. 4 shows a schematic diagram of a method 400 for generating an encoding parameter according to an implementation form. The method 400 is for generating the encoding parameter ICC for an audio channel signal $x_1[n]$ of a plurality of audio channel signals $x_1[n]$, $x_2[n]$ of a multi-channel audio signal. Each audio channel signal $x_1[n]$, $x_2[n]$ has audio channel signal values. FIG. 4 depicts the stereo case where the plurality of audio channel signals comprises a left audio channel $x_1[n]$ and a right audio channel $x_2[n]$. The method 400 comprises: applying an FFT transform 401 to the left audio channel signal $x_1[n]$ and applying an FFT transform 403 to the right audio channel signal $x_2[n]$ to obtain frequency-domain audio channel signals $X_1[b]$ and $X_2[b]$, where $X_1[b]$ is the left audio channel signal and $X_2[b]$ is the right audio channel signal with respect to frequency bin [b] in frequency domain. Alternatively, a filter-bank transform is applied to the left audio channel signal $x_1[n]$ and to the right audio channel signal $x_2[n]$ to obtain audio channel signals $X_1[b]$, $X_2[b]$ in frequency sub-bands, where [b] denotes the frequency sub-band;

determining 405 a cross-correlation c[b] of each frequency bin [b] of the left audio channel signal $X_1[b]$ and the right audio channel signal $X_2[b]$; or alternatively determining 405 a cross-correlation c[b] of each frequency sub-band [b] of the left audio channel signal $X_1[b]$ and the right audio channel signal $X_2[b]$;

determining 407 for the audio channel signal $X_1[b]$ of the plurality of audio channel signals a first set of encoding parameters IPD[b] from the audio channel signal values of the audio channel signal $X_1[b]$ and reference audio signal values of a reference audio signal $X_2[b]$, wherein the reference audio signal is another audio channel signal $X_2[b]$ of the plurality of audio channel signals or a down-mix audio signal derived from at least two audio channel signals of the plurality of multi-channel audio signals. FIG. 4 depicts the stereo case, where the determining 407 determines for the left audio channel signal $X_1[b]$ the first set of encoding parameters IPD[b] and where the reference audio signal is the right audio channel signal $X_2[h]$;

determining 409 for the audio channel signal $X_1[b]$ a first encoding parameter average $IPD_{mean}[i]$ based on the first set of encoding parameters IPD[b] of the audio channel signal $X_1[b]$;

determining 411 for the audio channel signal $X_1[b]$ a second encoding parameter average $IPD_{mean_long_term}$ based on the first encoding parameter average $IPD_{mean}[i]$ of the audio channel signal $X_1[b]$ and at least one other first encoding parameter average $IPD_{mean}[i-1]$ of the audio channel signal $X_1[b]$. The other first encoding parameter average $IPD_{mean}[i-1]$ is computed from previous N−1 frames of the audio channel signal $X_1[b]$; and determining 413 or calculating the encoding parameter ICC based on the first encoding parameter average $IPD_{mean}[i]$ of the audio channel signal $X_1[b]$ and the second encoding parameter average $IPD_{mean_long_term}$ of the audio channel signal $X_1[b]$.

In an implementation form, the first set of encoding parameters IPD[b] of the audio channel signal $X_1[b]$ is already available and the method 400 starts with the steps 409, 411 and 413 as described above.

Although not depicted in FIG. 4, the method 400 is applicable to the general case of multi-channel audio signals, the reference signal is then another audio channel signal or a down-mix audio signal as described above with respect to FIG. 1.

In an implementation form, the method 400 is processed as follows:

In a first step 401, 403, a time frequency transform is applied on the input channels (left and right in case of stereo). In a preferred embodiment, the time frequency transform is a Fast Fourier Transform (FFT). In alternative embodiment, the time frequency transform can be cosine modulated filter bank or a complex filter bank.

In a second step 405, a cross-spectrum for each frequency bin of the FFT is computed $$c[b]=X_1[b]X_2^*[b]$$

where a sub-band [b] corresponds directly to one frequency bin [k], frequency bin [b] and [k] represent exactly the same frequency bin.

Alternatively, the cross spectrum can be computed per sub band as $c[b]=\Sigma_{k=k_b}^{k_{b+1}-1}X_1[k]X_2^*[k]$ where c [b] is the cross-spectrum of bin b or subband b. $X_1[k]$ and $X_2[k]$ are the FFT coefficients of the two channels (for instance left and right channels in case of stereo). * denotes complex conjugation. $k_b$ is the start bin of subband b and $k_{b+1}$ is the start bin of the adjacent sub-band b+1. Hence, the frequency bins [k] of the FFT between $k_b$ and $k_{b+1}-1$ represent the sub-bands [b].

In a third step 407, the inter channel phase differences (IPDs) are calculated per sub band based on the cross-spectrum as:

$$IPD[b]=\angle c[b]$$

where the operation a?? is the argument operator to compute the angle of c[b].

In a fourth step 409, the averaged IPD ($IPD_{mean}$), over the frequency bins (or frequency sub bands) is also computed as defined in the following equation:

$$IPD_{mean}=\frac{\sum_{k=1}^{K} IPD[k]}{K}$$

where K is the number of the frequency bins or frequency sub bands which are taken into account for the computation of the average.

In a fifth step 411, based on the previously computed $IPD_{mean}$ a long term average of the IPD is calculated. The $IPD_{mean_long_term}$ is computed as the average over the last N frames (for instance N can be set to 10).

$$IPD_{mean_long_term}=\frac{\sum_{i=1}^{N} IPD_{mean}[i]}{N}$$

In order to evaluate the stability of the IPD parameter, the distance between $IPD_{mean}$ and $IPD_{mean_long_term}$ ($IPD_{dist}$) is computed, which shows the evolution of the IPD during the last N frames. In a preferred embodiment, the distance between the local and long term IPD is calculated as the absolute value of the difference between the local and the long term average:

$$IPD_{dist}=abs(IPD_{mean}-IPD_{mean_long_term})$$

It can be seen that if the $IPD_{mean}$ parameter is stable over the previous frames, the distance $IPD_{dist}$ becomes close to 0. The distance is then equal to zero when the phase difference is stable over the time. This distance gives a good estimation of the similarity of the channels.

In a sixth step 413, the coherence or ICC parameter is calculated by $ICC=1-IPD_{dist}$, since ICC and $IPD_{dist}$ have an indirect inverse relation. ICC is close to 1 when the channels are similar and $IPD_{dist}$ becomes equal to 0 in that case.

In an alternative implementation form of the sixth step 413, the equation to define the relation between ICC and $IPD_{dist}$ is defined as $ICC=d-e.IPD_{dist}$ with the parameters d and e being chosen to better represent the inverse relation between the two parameters ICC and $IPD_{dist}$. In a further implementation form of the sixth step 413, the relation between ICC and $IPD_{dist}$ is obtained by training over a large database and can then be generalized as $ICC=f(IPD_{dist})$.

During a correlated segment of an audio signal (for instance for speech signal), the $IPD_{dist}$ is small and during diffuse parts of the audio input (for instance for music signal), this $IPD_{dist}$ parameter becomes much bigger and will be close to 1 if the input channels are decorrelated. Thus, ICC and $IPD_{dist}$ have an indirect inverse relation.

From the foregoing, it will be apparent to those skilled in the art that a variety of methods, systems, computer programs on recording media, and the like, are provided.

The present disclosure also supports a computer program product including computer executable code or computer executable instructions that, when executed, causes at least one computer to execute the performing and computing steps described herein.

The present disclosure also supports a system configured to execute the performing and computing steps described herein.

Many alternatives, modifications, and variations will be apparent to those skilled in the art in light of the above teachings. Of course, those skilled in the art readily recognize that there are numerous applications of the invention beyond those described herein. While the present inventions has been described with reference to one or more particular embodiments, those skilled in the art recognize that many changes may be made thereto without departing from the spirit and scope of the present invention. It is therefore to be understood that within the scope of the appended claims and their equivalents, the inventions may be practiced otherwise than as specifically described herein.

A corresponding embodiment of the present invention can be applied in the encoder of the stereo extension of ITU-T G.722, G.722 Annex B, G.711.1 and/or G.711.1 Annex D. Moreover, the described method can also be applied for speech and audio encoder for mobile application as defined in 3GGP EVS (Enhanced Voice Services) codec.

What is claimed is:

1. A parametric audio encoder for generating an encoding parameter (ICC) for an audio channel signal ($X_1[b]$) of a plurality of audio channel signals ($X_1[b]$, $X_2[b]$) of a multi-channel audio signal, each audio channel signal ($X_1[b]$, $X_2[b]$) having audio channel signal values ($X_1[k]$, $X_2[k]$), the parametric audio encoder comprising:

a parameter generator configured to:

determine for the audio channel signal ($X_1[b]$) of the plurality of audio channel signals a first set of encoding parameters (IPD[b]) from the audio channel signal values ($X_1[k]$) of the audio channel signal ($X_1[b]$) and reference audio signal values ($X_2[k]$) of a reference audio signal ($X_2[b]$), wherein the reference audio signal is another audio channel signal ($X_2[b]$) of the plurality of audio channel signals or a downmix audio signal derived from at least two audio channel signals of the plurality of multi-channel audio signals, determine for the audio channel signal ($X_1[b]$) a first encoding parameter average ($IPD_{mean}[i]$) based on the first set of encoding parameters (IPD[b]) of the audio channel signal ($X_1[b]$), determine for the audio channel signal ($X_1[b]$) a second encoding parameter average ($IPD_{mean—long—term}$) based on the first encoding parameter average ($IPD_{mean}[i]$) of the audio channel signal ($X_1[b]$) and at least one other first encoding parameter average ($IPD_{mean}[i-1]$) of the audio channel signal ($X_1[b]$), determine the encoding parameter (ICC) based on the first encoding parameter average ($IPD_{mean}[i]$) of the audio channel signal ($X_1[b]$) and the second encoding parameter average ($IPD_{mean_long_term}$) of the audio channel signal ($X_1[b]$), and determine an absolute value ($IPD_{dist}$) of a difference between the second encoding parameter average ($IPD_{mean_long_term}$) and the first encoding parameter average ($IPD_{mean}[i]$).

2. The parametric audio encoder of claim 1, wherein the first set of encoding parameters (IPD[b]) includes at least one of the following parameters:

inter-channel level difference,
inter-channel phase difference,
inter-channel coherence,
inter-channel intensity difference,
sub-band inter-channel level difference,
sub-band inter-channel phase difference,
sub-band inter-channel coherence, and
sub-band inter-channel intensity difference.

3. The parametric audio encoder of claim 1, wherein the parameter generator is configured to determine phase differences of subsequent audio channel signal values ($X_1[k]$) to obtain the first set of encoding parameters (IPD[b]).

4. The parametric audio encoder of claim 2, wherein the parameter generator is configured to determine phase differences of subsequent audio channel signal values ($X_1[k]$) to obtain the first set of encoding parameters (IPD[b]).

5. The parametric audio encoder of claim 1, wherein the audio channel signal ($X_1[b]$) and the reference audio signal ($X_2[b]$) are frequency-domain signals, and wherein the audio channel signal values ($X_1[k]$) and the reference audio signal values ($X_2[k]$) are associated with frequency bins (k) or frequency sub-bands (b).

6. The parametric audio encoder of claim 2, wherein the audio channel signal ($X_1[b]$) and the reference audio signal ($X_2[b]$) are frequency-domain signals, and wherein the audio channel signal values ($X_1[k]$) and the reference audio signal values ($X_2[k]$) are associated with frequency bins (k) or frequency sub-bands (b).

7. The parametric audio encoder of claim 1, further comprising a transformer (FFT) for transforming a plurality of time-domain audio channel signals ($x_1[n]$, $x_2[n]$) in frequency domain to obtain the plurality of audio channel signals ($X_1[b]$, $X_2[b]$).

8. The parametric audio encoder of claim 2, further comprising a transformer (FFT) for transforming a plurality of time-domain audio channel signals ($x_1[n]$, $x_2[n]$) in frequency domain to obtain the plurality of audio channel signals ($X_1[b]$, $X_2[b]$).

9. The parametric audio encoder of claim 1, wherein the parameter generator is configured to determine the first set of encoding parameters (IPD[b]) for each frequency bin ([k]) or for each frequency subband ([b]) of the audio channel signals ($X_1[b]$, $X_2[b]$).

10. The parametric audio encoder of claim 2, wherein the parameter generator is configured to determine the first set of encoding parameters (IPD[b]) for each frequency bin ([k]) or for each frequency subband ([b]) of the audio channel signals ($X_1[b]$, $X_2[b]$).

11. The parametric audio encoder of claim 1, wherein the parameter generator is configured to determine the first encoding parameter average ($IPD_{mean}[i]$) of the audio channel signal ($X_1[b]$) as an average of the first set of encoding parameters (IPD[b]) of the audio channel signal ($X_1[b]$) over frequency bins [k] or frequency subbands [b].

12. The parametric audio encoder of claim 1, wherein the parameter generator is configured to determine the second encoding parameter average ($IPD_{mean_long_term}$) of the audio channel signal ($X_1[b]$) as an average of a plurality of first encoding parameter averages ($IPD_{mean}[i]$) over a plurality of frames of the audio channel signal ($X_1[b]$), wherein each first encoding parameter average ($IPD_{mean}[i]$) is associated to a frame (i) of the multi-channel audio signal.

13. The parametric audio encoder of claim 1, wherein the parameter generator is configured to determine the encoding parameter (ICC) as a function of the determined absolute value ($IPD_{dist}$).

14. The parametric audio encoder of claim 1, wherein the parameter generator is configured to determine the encoding parameter (ICC) from a difference between a first parameter value (d) and the determined absolute value ($IPD_{dist}$) multiplied by a second parameter value (e).

15. The parametric audio encoder of claim 14, wherein the parameter generator is configured to set the first parameter value (d) to one and to set the second parameter value (e) to one.

16. The parametric audio encoder of claim 1, further comprising a downmix signal generator for superimposing at least two of the audio channel signals of the multi-channel audio signal to obtain a downmix signal, an audio encoder, in particular a mono encoder, for encoding the downmix signal to obtain an encoded audio signal, and a combiner for combining the encoded audio signal with a corresponding encoding parameter.

17. The parametric audio encoder of claim 2, wherein the parameter generator is configured to determine an absolute value ($IPD_{dist}$) of a difference between the second encoding parameter average ($IPD_{mean_long_term}$) and the first encoding parameter average ($IPD_{mean}[i]$).

18. A method for generating an encoding parameter (ICC) for an audio channel signal ($X_1[b]$) of a plurality of audio channel signals ($X_1[b]$, $X_2[b]$) of a multi-channel audio signal, each audio channel signal ($X_1[b]$, $X_2[b]$) having audio channel signal values ($X_1[k]$, $X_2[k]$), the method comprising:

determining for the audio channel signal ($X_1[b]$) of the plurality of audio channel signals a first set of encoding parameters (IPD[b]) from the audio channel signal values ($X_1[k]$) of the audio channel signal ($X_1[b]$) and reference audio signal values ($X_2[k]$) of a reference audio signal ($X_2[b]$), wherein the reference audio signal is another audio channel signal ($X_2[b]$) of the plurality of audio channel signals or a downmix audio signal derived from at least two audio channel signals of the plurality of multi-channel audio signals, determining for the audio channel signal ($X_1[b]$) a first encoding parameter average ($IPD_{mean}[i]$) based on the first set of encoding parameters (IPD[b]) of the audio channel signal ($X_1[b]$), determining for the audio channel signal ($X_1[b]$) a second encoding parameter average ($IPD_{mean_long_term}$) based on the first encoding parameter average ($IPD_{mean}[i]$) the audio channel signal ($X_1[b]$) and at least one other first encoding parameter average ($IPD_{mean}[i-1]$) of the audio channel signal ($X_1[b]$), and determining the encoding parameter (ICC) based on the first encoding parameter average ($IPD_{mean}[i]$) of the audio channel signal ($X_1[b]$) and the second encoding parameter average ($IPD_{mean_long_term}$) of the audio channel signal ($X_1[b]$), and determining an absolute value ($IPD_{dist}$) of a difference between the second encoding parameter average ($IPD_{mean_long_term}$) and the first encoding parameter average ($IPD_{mean}[i]$).

19. The method according to claim 18, further comprising determining the encoding parameter (ICC) as a function of the determined absolute value ($IPD_{dist}$).

* * * * *